US010645985B2

(12) United States Patent
Lomax et al.

(10) Patent No.: US 10,645,985 B2
(45) Date of Patent: May 12, 2020

(54) TRIM PIECE FOR AN APPAREL ITEM

(71) Applicant: NIKE, Inc., Beaverton, OR (US)

(72) Inventors: Jessica Lomax, Portland, OR (US); Nahid Nooshi, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 120 days.

(21) Appl. No.: 15/595,208

(22) Filed: May 15, 2017

(65) Prior Publication Data

US 2017/0325531 A1 Nov. 16, 2017

Related U.S. Application Data

(60) Provisional application No. 62/337,130, filed on May 16, 2016.

(51) Int. Cl.

| | |
|---|---|
| ***A41F 9/02*** | (2006.01) |
| ***A41F 1/02*** | (2006.01) |
| *A41F 1/00* | (2006.01) |

(52) U.S. Cl.

CPC ..... *A41F 9/025* (2013.01); *A41F 1/02* (2013.01); *A41D 2300/33* (2013.01); *A41F 1/00* (2013.01); *A41F 9/02* (2013.01)

(58) Field of Classification Search

CPC ..... A41F 9/025; A41B 9/14
USPC ..... 2/236, 237, 336
See application file for complete search history.

(56) References Cited

U.S. PATENT DOCUMENTS

| | | | | |
|---|---|---|---|---|
| 181,155 | A | 8/1876 | Eager | |
| 403,457 | A | 5/1889 | Brown | |
| 464,916 | A | 12/1891 | Tayloe | |
| 568,339 | A | 9/1896 | Dockham | |
| 770,871 | A | 9/1904 | Slater | |
| 898,511 | A * | 9/1908 | Schneider | A41F 9/025 2/108 |
| 918,324 | A | 4/1909 | Holdgate | |
| 1,208,132 | A | 12/1916 | Gaines | |
| 2,375,845 | A | 5/1945 | Herscovici | |
| 2,541,713 | A | 2/1951 | Neilson | |
| 2,775,770 | A | 1/1957 | Keller | |
| 3,161,890 | A | 12/1964 | Betz | |
| 4,164,792 | A * | 8/1979 | Ito | A41F 9/025 2/108 |

(Continued)

FOREIGN PATENT DOCUMENTS

| | | | |
|---|---|---|---|
| JP | 3146747 | * 11/2008 | A41F 9/025 |
| JP | 3146747 U | 11/2008 | |

OTHER PUBLICATIONS

International Preliminary Report on Patentablity dated May 21, 2018 in International Patent Application No. PCT/US2017/032794, 7 pages.

(Continued)

*Primary Examiner* — Katherine M Moran

(74) *Attorney, Agent, or Firm* — Shook, Hardy & Bacon L.L.P.

(57) ABSTRACT

A trim piece assembly is provided herein comprising a first set of apertures providing access to a drawstring channel, and a second set of apertures that do not provide access to the drawstring channel. The trim piece assembly may be incorporated into various apparel items, such that the trim piece assembly allows for a drawstring to be positioned on an interior surface or exterior surface of the apparel item.

19 Claims, 9 Drawing Sheets

(56) References Cited

U.S. PATENT DOCUMENTS

| | | | | |
|---|---|---|---|---|
| 5,577,306 | A * | 11/1996 | Gold | A41F 1/06 24/300 |
| 5,784,723 | A * | 7/1998 | Noble | A41C 1/003 2/228 |
| 6,317,894 | B1 | 11/2001 | Blechman | |
| 6,618,863 | B2 | 9/2003 | Blechman | |
| D504,754 | S | 5/2005 | Rocha | |
| 7,950,070 | B2 | 5/2011 | Beven | |
| 8,429,762 | B2 | 4/2013 | Weisman | |
| 9,078,476 | B2 | 7/2015 | Haueter | |
| 9,149,081 | B2 | 10/2015 | Wilson, II | |
| 9,271,534 | B2 | 3/2016 | Geary | |
| 2007/0028363 | A1 | 2/2007 | Hansen | |
| 2012/0011638 | A1* | 1/2012 | Geary | A41F 9/025 2/336 |
| 2013/0007947 | A1* | 1/2013 | Moore | A41F 9/02 2/236 |
| 2014/0047619 | A1 | 2/2014 | Singh et al. | |
| 2014/0130236 | A1 | 5/2014 | Mack | |
| 2015/0020286 | A1 | 1/2015 | Wilson, II | |
| 2017/0258159 | A1* | 9/2017 | Moore | A41D 7/005 |
| 2018/0184739 | A1* | 7/2018 | Satumio | A41F 9/025 |

OTHER PUBLICATIONS

"Vertex zip pocket short," hylete.com. Mar. 29, 2016. http://web.archive.org/web/20160329104645/http://www.hylete.com/crosstrainingshort20gunmetalstealthblack.

"Patterned Board Shorts for Boys," oldnavy.gap.com. Accessed: May 4, 2016. http://oldnavy.gap.com/browse/product.do?pid=210180002.

"Reebok Crossfit Super Nasty Hero Board Short," reebok.com. Apr. 4, 2016. http://web.archive.org/web/20160404184347/http://www.reebok.com/us/reebokcrossfitsupernastyheroboardshort/AI1480.html.

International Search Report and Written Opinion dated Sep. 12, 2017 in International Patent Application No. PCT/US2017/032794, 13 pages.

* cited by examiner

TRIM PIECE FOR AN APPAREL ITEM

CROSS-REFERENCE TO RELATED APPLICATIONS

This application having U.S. application Ser. No. 15/595,208 and entitled "TRIM PIECE FOR AN APPAREL ITEM" claims the benefit of U.S. Provisional Application No. 62/337,130, entitled "TRIM PIECE FOR AN APPAREL ITEM," and filed May 16, 2016. The entirety of the aforementioned application is incorporated by reference herein.

TECHNICAL FIELD

The present disclosure relates to a trim piece, such as a waistband, for an apparel item.

BACKGROUND

Various types of trim pieces have been proposed for retaining pants, shorts, bras, and other apparel items on the torso of the wearer. Specifically, the trim piece can be an annular member that is attached to the apparel item. In some instances, a drawstring may be used to help hold the trim piece to the wearer's body.

BRIEF DESCRIPTION OF THE DRAWINGS

The present invention is described in detail herein with reference to the attached drawing figures, wherein.

DETAILED DESCRIPTION

Figure 1:
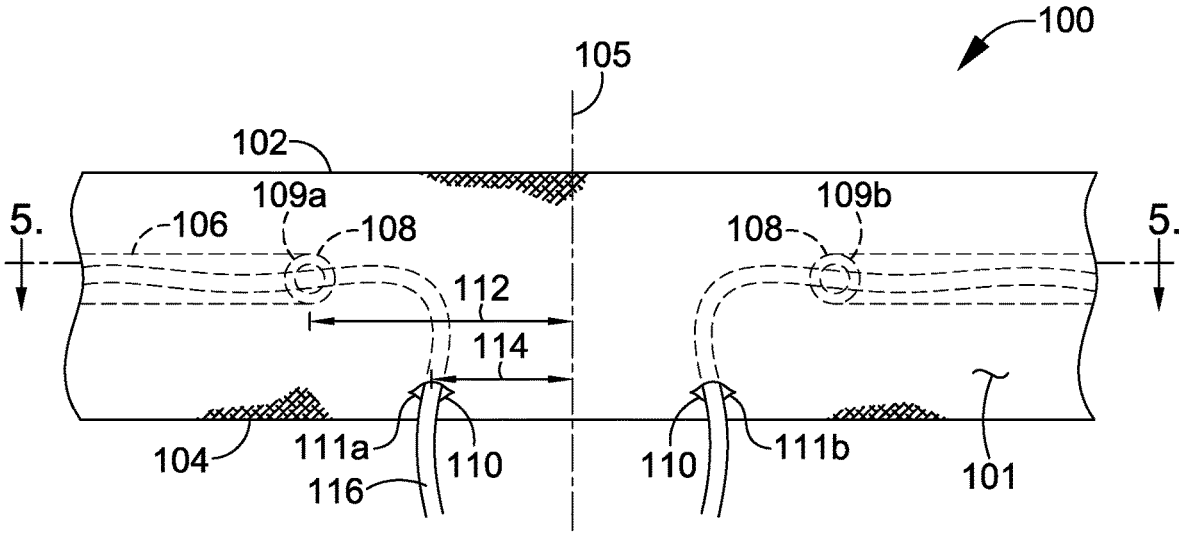
FIG. 1 depicts a front view of an exemplary trim piece assembly, in accordance with aspects herein.

The subject matter of the present invention is described with specificity herein to meet statutory requirements. However, the description itself is not intended to limit the scope of this disclosure. Rather, the inventors have contemplated that the disclosed or claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein are generally directed to an exemplary trim piece assembly, such as a waistband, an underband of a bra or other support garment, a sleeve cuff, a pant cuff, and the like. In general, the exemplary trim piece assembly described herein comprises a trim piece having an upper margin, a lower margin, an exterior surface and an interior surface. In accordance with aspects herein, the trim piece assembly comprises a drawstring channel positioned on the trim piece and a drawstring positioned within the drawstring channel. Additionally, the trim piece assembly further comprises a first set of apertures providing access to the drawstring channel, wherein the first set of apertures are generally located on an interior surface of the trim piece assembly, and a second set of apertures extending from the exterior surface to the interior surface of the trim piece. Further, the first set of apertures is generally positioned a first distance away from a front centerline of the trim piece assembly, while the second set of apertures is generally positioned a second distance away from the front centerline of the trim piece assembly, where the first distance is generally greater than the second distance.

By positioning the first set of apertures on the interior surface of the trim piece assembly, and by having the second set of apertures extend from the interior surface to the exterior surface of the trim piece, the drawstring ends can be positioned on either the interior surface or the exterior surface of the trim piece. For example, the drawstring ends may exit the drawstring channel via the first set of apertures such that the ends are positioned adjacent the interior surface of the trim piece. A wearer may then thread the free ends of the drawstring through the second set of apertures such that the free ends of the drawstring are positioned adjacent the exterior surface of the trim piece. When the wearer desires to have the free ends of the drawstring positioned adjacent the interior surface of the trim piece, the wearer can simply pull the free ends of the drawstring back through the second set of apertures. As such, the exemplary trim piece assembly described herein is generally referred to as "reversible", as the wearer may hide or expose the drawstring ends according to his or her preference. Similarly, if the trim piece assembly is in a "reversed" configuration, the drawstring may be hidden or exposed by threading or removing the free ends of the drawstring through the second set of apertures, as desired by the wearer.

Additionally, in accordance with aspects herein, another advantage of the trim piece assembly described herein is a reduced amount of wear and tear on the first set of apertures that are in communication with the drawstring channel. For example, by having the free ends of the drawstring threaded through the second set of apertures before tying the free ends of the drawstring together, less stress may be imposed on the apertures that are in communication with the drawstring channel. In this manner, the structural integrity of the first set of apertures, and the drawstring channel, may be prolonged.

Further, another advantage of the exemplary trim piece assembly described herein is that the configuration of the first and second sets of apertures makes it less likely to lose a free end of the drawstring inside of the drawstring channel. A well-known problem with existing trim piece assemblies having only one set of apertures in communication with the drawstring channel is that one or both ends of a drawstring will "get lost" within the drawstring channel, rendering the drawstring inoperable. In accordance with aspects herein, the exemplary trim piece assembly may help to alleviate the problem of one or both free ends of a drawstring becoming lost within the drawstring channel. For instance, when the drawstring ends are positioned adjacent the exterior surface of the trim piece, the free ends of the drawstring would have to pass through both the first and second sets of apertures to become lost within the drawstring channel, as opposed to only having to pass through one aperture to become lost within the drawstring channel.

Another advantage of the exemplary trim piece assembly is provided by positioning the second set of apertures closer to the front centerline of the trim piece assembly. This enables a bow formed at the exterior surface of the trim piece assembly to be generally smaller, tighter, and more aesthetically pleasing.

Accordingly, in a first aspect, a trim piece assembly is provided comprising a trim piece having an upper margin, a lower margin, an exterior surface, and an interior surface. The trim piece assembly further comprises a drawstring channel positioned on the trim piece, and a first set of apertures providing access to the drawstring channel, where the first set of apertures is positioned a first distance away from a front centerline of the trim piece. The trim piece assembly further comprises a second set of apertures extending from the exterior surface to the interior surface of the trim piece, where the second set of aperture is positioned a second distance away from the front centerline of the trim piece.

In another aspect, a waistband assembly is provided comprising a drawstring channel that extends circumferentially around the waistband assembly terminating at a front portion thereof. The waistband assembly further comprises a first pair of apertures at the front portion of the waistband assembly, where the first pair of apertures is positioned a first distance from a front centerline of the waistband assembly on opposing sides of the front centerline, and where the first pair of apertures provides access to the drawstring channel. The waistband assembly further comprises a second pair of apertures at the front portion of the waistband assembly, where the second pair of apertures is positioned a second distance from the front centerline of the waistband assembly on opposing sides of the front centerline, and where the second pair of apertures extends from an exterior surface to an interior surface of the waistband assembly.

In yet another aspect, a trim piece assembly incorporated into a garment is provided comprising an interior surface, an exterior surface, an upper margin, and a lower margin. The trim piece further comprises a drawstring channel extending circumferentially around the trim piece and terminating adjacent a front centerline thereof, and a first pair of apertures positioned a first distance away from the front centerline, where the first pair of apertures provides access to the drawstring channel. The trim piece assembly further comprises a second pair of apertures positioned a second distance away from the front centerline, where the second pair of apertures extends from the interior surface to the exterior surface of the trim piece.

Turning now to FIG. 1, a front view of a portion of an exemplary trim piece assembly 100 is depicted in accordance with aspects herein. Generally speaking, the trim piece assembly 100 is formed as an annular member, although trim piece assemblies which are not annular are considered within the scope of this disclosure. The trim piece assembly 100 generally comprises an exterior surface 101 and an interior surface 103 (shown in FIG. 2). In accordance with aspects herein, a first continuous material layer may form the interior surface 103 of the trim piece assembly 100, and a second continuous material layer may form the exterior surface 101 of the time piece assembly 100. The exterior surface 101 may comprise an integral extension of the interior surface 103 (i.e., a unitary construction), or the exterior surface 101 may comprise a separate element from the interior surface 103. Any and all aspects, and any variation thereof, are contemplated as being within the scope herein. The exterior surface 101 and the interior surface 103 may be formed from standard textile elements. For instance, both may be formed from an elastically resilient material, such as a mesh material, generated through a knitting or weaving process although it is contemplated here that the material may not be elastically resilient. In this instance, other components may be used to bias the trim piece assembly 100 toward a body surface of a wearer. Such components may comprise, for instance, drawstrings, elastic cords or ribbons, and the like. Any and all aspects, and any variation thereof, are contemplated as being within the scope herein.

The trim piece assembly 100 further comprises an upper margin 102 and a lower margin 104. In accordance with aspects herein, a drawstring channel 106 may be positioned on the trim piece assembly 100, such that the drawstring channel 106 is operable to receive a drawstring. In exemplary aspects, the drawstring channel 106 may be positioned between the exterior surface 101 and the interior surface 103, although it is contemplated that in other aspects, the drawstring channel 106 may be formed directly on the exterior surface 101 or the interior surface 103 of the trim piece assembly 100. For instance, when a knitting or weaving process is used to form the exterior surface 101, the knitting or weaving process may be modified to create the drawstring channel 106. Similarly, when a knitting or weaving process is used to form the interior surface 103, the knitting or weaving process may be modified to create the drawstring channel 106. Any and all aspects, and any variation thereof, are contemplated as being within the scope herein.

With continued reference to FIG. 1, the trim piece assembly 100 further comprises a first set of apertures 108, which provide a communication path between the drawstring channel 106 and the interior surface 103 of the trim piece assembly 100. In other words, a drawstring 116 may run through the drawstring channel 106 and exit the drawstring channel 106 via the first set of apertures 108. This is more clearly shown in FIG. 5. To put it yet another way, the first set of apertures 108 extend from the drawstring channel 106 to the interior surface 103 of the trim piece assembly 100.

Still with reference to FIG. 1, the first set of apertures 108 may comprise a first aperture 109*a* and a second aperture 109*b*, where both the first aperture 109*a* and the second aperture 109*b* are positioned a first distance 112 away from a front centerline 105 of the trim piece assembly 100. The front centerline 105 is a hypothetical midline that bisects the trim piece assembly 100 into generally equal right and left halves. It does not exist in reality and is merely provided as a means of facilitating the reader's understanding of aspects herein. As described herein, the first aperture 109*a* and the second aperture 109*b* are equidistant from the front centerline 105 on opposing sides of the front centerline 105. However, it is contemplated herein that the first and second apertures 109*a* and 109*b* may not be equidistant from the front centerline 105. In other words, the positions of the first aperture 109*a* and the second aperture 109*b* do not need to be symmetrical, and other non-symmetrical locations for first aperture 109*a* and the second aperture 109*b* are considered to be within the scope of this disclosure.

Still with reference to FIG. 1, the trim piece assembly 100 may further comprise a second set of apertures 110, which may be positioned a second distance 114 away from the front centerline 105. In exemplary aspects, the second set of apertures 110 may extend from the exterior surface 101 to the interior surface 103, such that the second set of apertures may be referred to as "through apertures." To put it another way, the second set of apertures 110 form a communication path from the exterior surface 101 to the interior surface 103 of the trim piece assembly 100. Additionally, the second set of apertures 110 may further comprise a first aperture 111*a* and a second aperture 111*b*. Similar to the first set of apertures 108, each of the second set of apertures 110 may be positioned equidistant to the front centerline 105, although it is contemplated herein that the first aperture 111*a* and the second aperture 111*b* may not be positioned symmetrically with respect to the front centerline 105.

Figure 2:
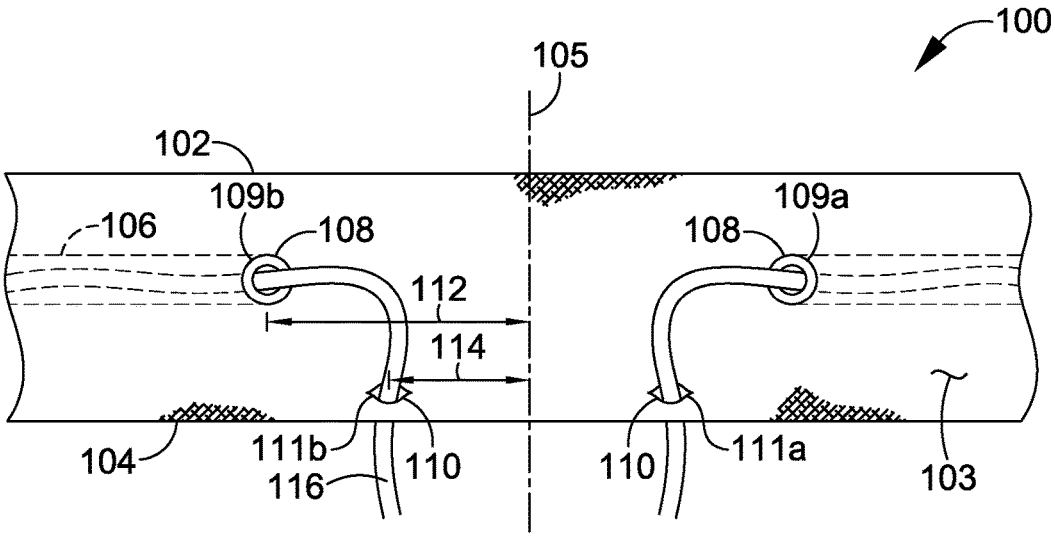
FIG. 2 depicts a back view of the exemplary trim piece assembly shown in FIG. 1, in accordance with aspects herein.

Turning now to FIG. 2, a back view of the exemplary trim piece assembly 100 of FIG. 1 is depicted in accordance with aspects herein. As such, as the front view of the trim piece assembly 100 shown in FIG. 1 provided a view of the exterior surface 101, the back view of the trim piece assembly 100 shown in FIG. 2 provides a view of the interior surface 103. In FIG. 2, the drawstring 116 is shown as positioned within the drawstring channel 106, and the ends of the drawstring 116 are shown as exiting the drawstring channel 106 by way of the first set of apertures 108. Continuing, FIG. 2 further depicts the ends of the drawstring 116 threaded through the second set of apertures 110, such that the ends of the drawstring 116 are positioned adjacent the exterior surface 101 of the trim piece assembly 100 as shown in FIG. 1. This configuration is exemplary only. As described previously, a wearer may choose whether or not to pass the ends of the drawstring 116 through the second set of apertures 110. When not threaded through the second set of apertures 110, the ends of the drawstring 116 would be positioned adjacent to the interior surface 103 of the trim piece assembly 100. In this sense, the trim piece assembly 100 is reversible, allowing for the wearer to decide whether or not the drawstring 116 is positioned adjacent the exterior surface 101 or the interior surface 103 of the trim piece assembly 100.

With continued reference to FIG. 2, when the ends of the drawstring 116 are optionally threaded through the second set of apertures 110, a portion of the drawstring 116 extends along the interior surface 103 between the first set of apertures 108 and second set of apertures 110 such that a small "loop" is formed. Described differently, the "loop" comprises the length of the drawstring 116 positioned between the first set of apertures 108 and the second set of apertures 110. This loop may be used when a wearer wishes to have the ends of the drawstring 116 positioned adjacent to the interior surface 103 of the trim piece assembly 100. A visual depiction of how the drawstring 116 may be manipulated is shown in FIGS. 7A-7D.

Figure 7A:
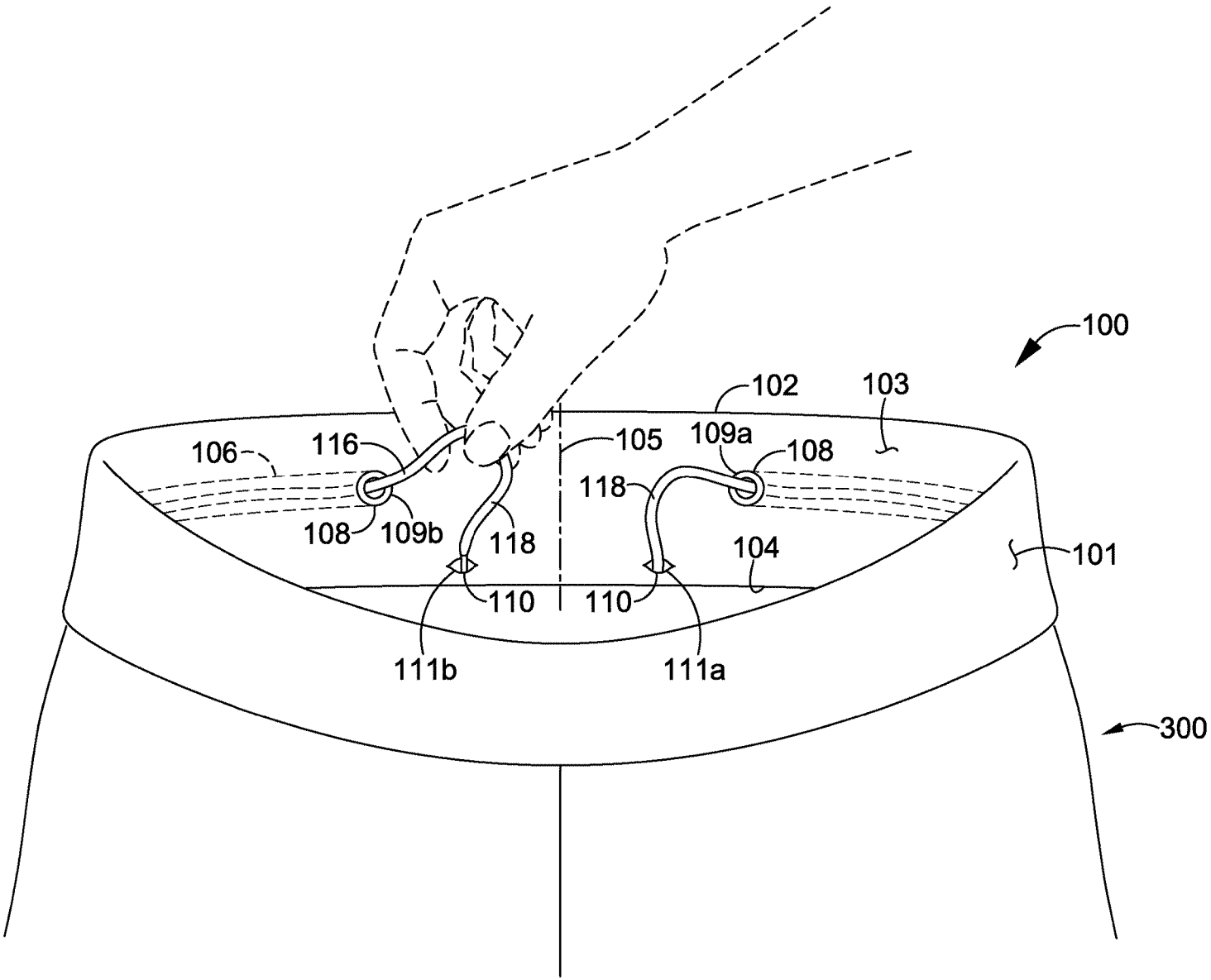
FIGS. 7A-7D depict an exemplary method of using the exemplary trim piece assembly described herein, in accordance with aspects herein.
Figure 7B:
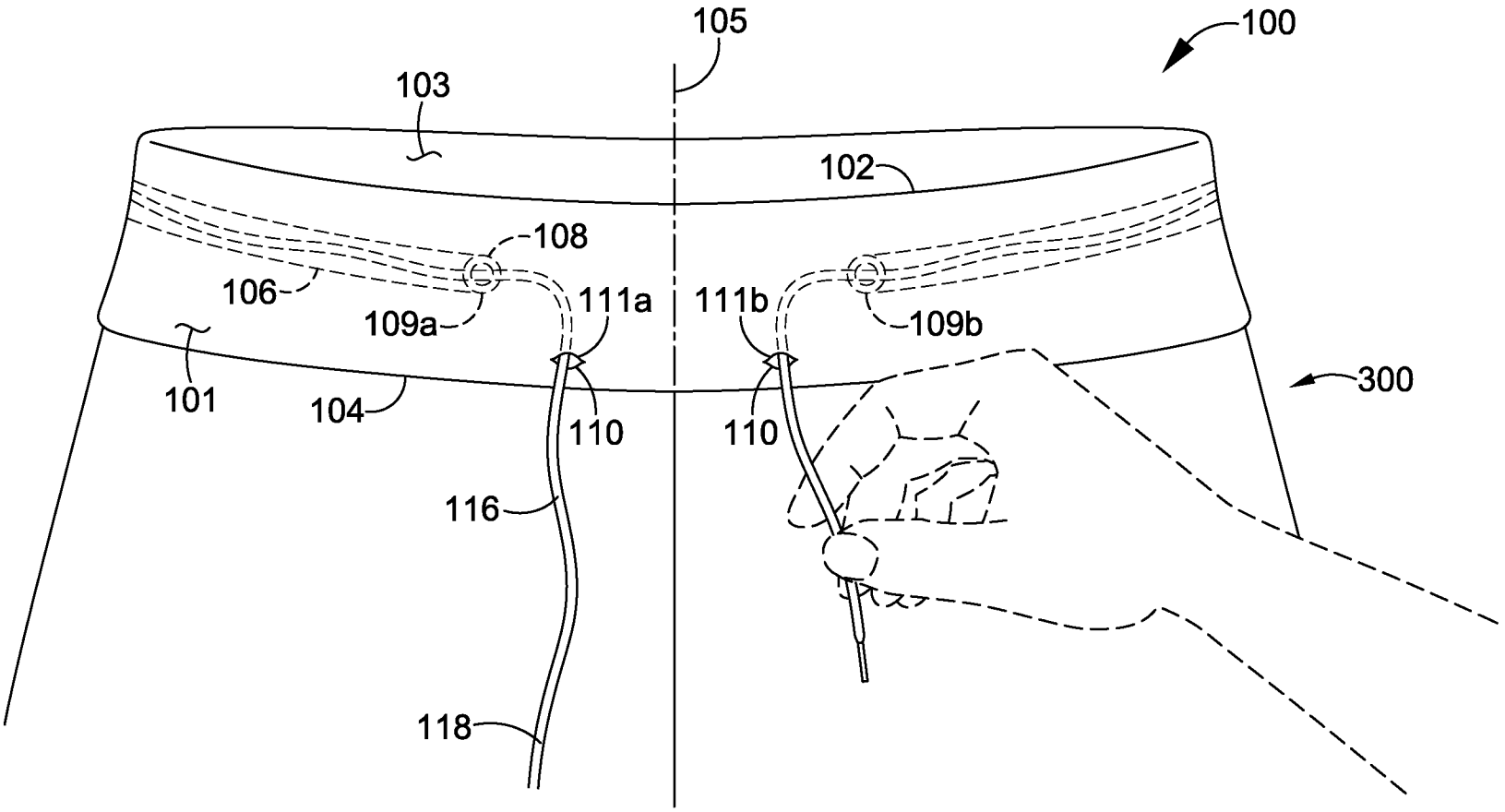

FIG. 7A depicts a wearer threading a first end 118 of the drawstring 116 through the first aperture 111*a* of the second set of apertures 110 (the second end 118 of the drawstring 116 has already been threaded through the second aperture 111*b* of the second set of apertures 110). FIG. 7B depicts the resulting configuration after both ends 118 of the drawstring 116 have been threaded through the first aperture 111*a* and the second aperture 111*b*. As shown in FIG. 7B, a wearer is able to continue pulling the ends 118 of the drawstring 116 through the second set of apertures 110. After the wearer has pulled the ends 118 to a desired length, the wearer may tie a bow or knot such that the bow or knot is positioned adjacent the exterior surface 101 of the trim piece assembly 100.

Figure 7C:
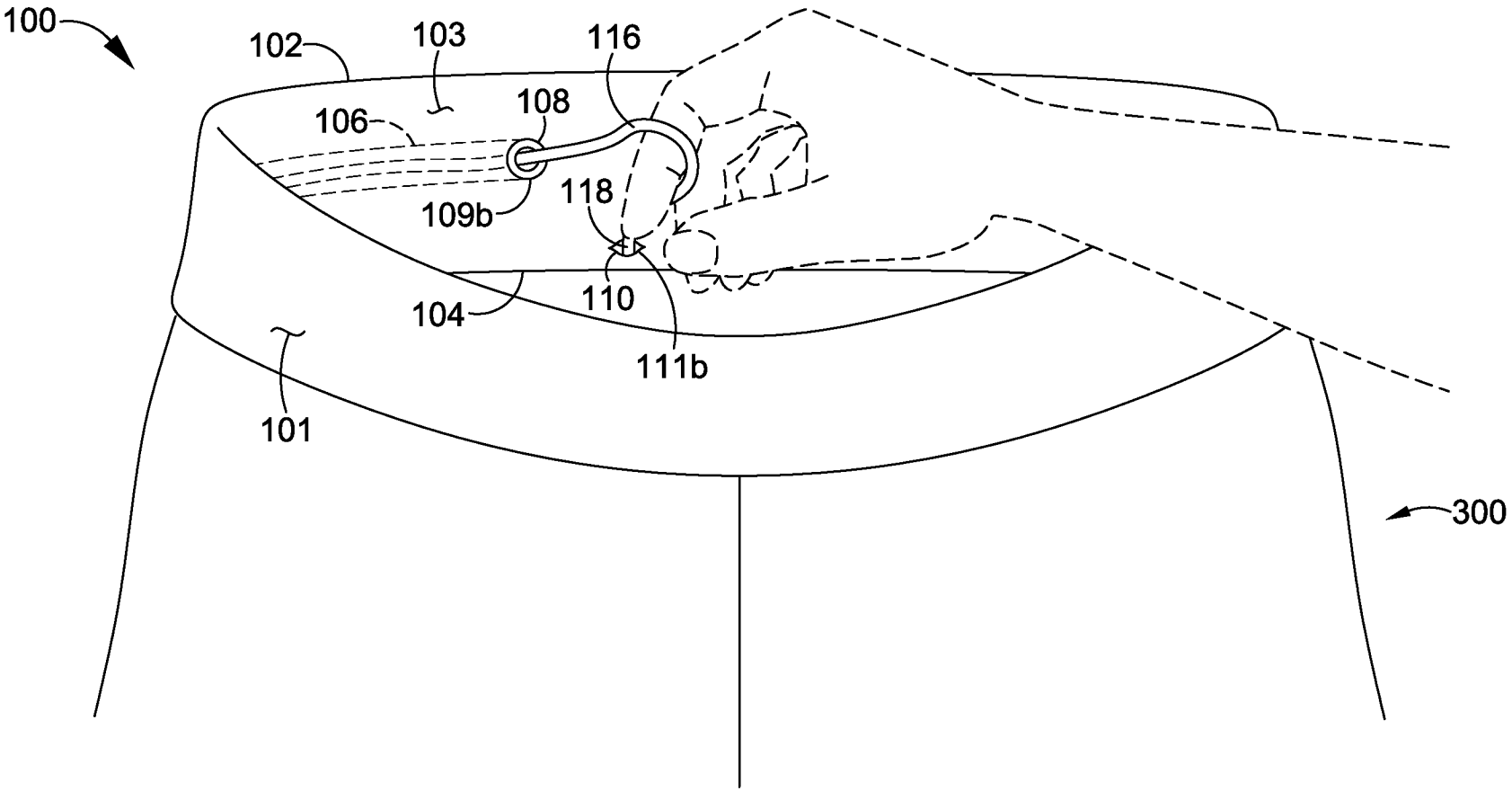

When the wearer desires to position the ends 118 of the drawstring 116 adjacent to the interior surface 103 of the trim piece assembly 100, the wearer can utilize the "loops" positioned adjacent to the interior surface 103 to quickly pull the ends 118 of the drawstring 116 back through the second set of apertures 110. This is shown in FIG. 7C which depicts the wearer inserting his or her finger into the "loop" of drawstring 116 formed between the first and second sets of apertures 108 and 110. This movement enables the ends 118 of the drawstring 116 to be easily pulled back inside of the trim piece assembly 100, such that the ends 118 of the drawstring 116 are positioned adjacent an interior surface 103. The size of the "loops" may be adjusted by varying the length of the drawstring 116 that is threaded from the interior surface 103 to the exterior surface 101 of the trim piece assembly 100 (e.g., less length pulled through equates to larger loops and more length pulled through equates to smaller loops).

Figure 7D:
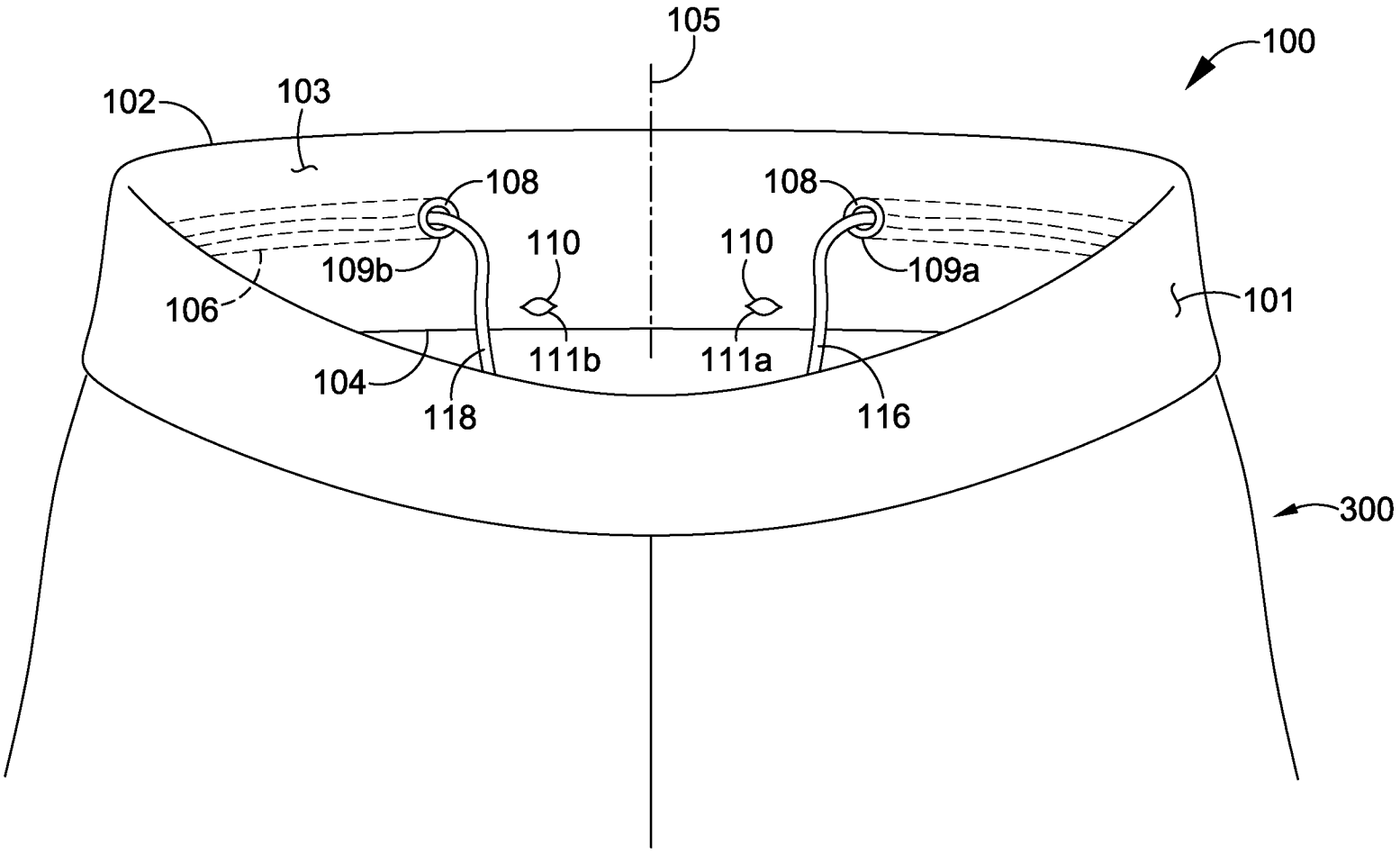

After the process depicted in FIG. 7C has been completed, FIG. 7D depicts that the ends 118 of the drawstring 116 are now positioned adjacent the interior surface 103 of the trim piece assembly 100. The wearer may then form a knot or bow such that the knot or bow is positioned adjacent the interior surface 103 of the trim piece assembly 100.

Figure 3:
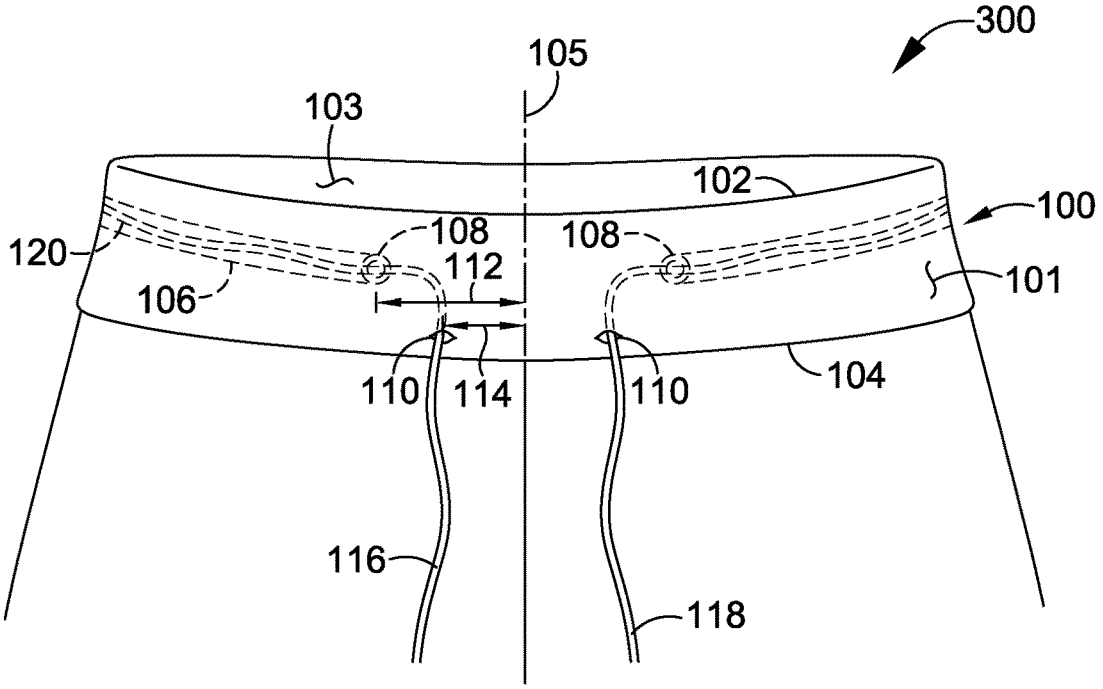
FIG. 3 depicts a front view of an exemplary trim piece assembly incorporated into an article of apparel, in accordance with aspects herein.

Turning now to FIG. 3, a front view of the exemplary trim piece assembly 100 is depicted as incorporated into an article of apparel 300 in accordance with aspects herein. In exemplary aspects, the article of apparel 300 may comprise a short, a pant, a legging, a tight, a capri, and the like. The article of apparel 300 is shown tilted slightly forward such that the interior surface 103 of the trim piece assembly 100 may be seen on a back portion of the article of apparel 300. In FIG. 3, the drawstring 116 is shown as comprising the drawstring ends 118 and a drawstring intervening portion 120 where the drawstring intervening portion 120 is generally positioned within the drawstring channel 106. In the exemplary aspect shown in FIG. 3, the drawstring ends 118 are positioned adjacent the exterior surface 101 of the trim piece assembly 100. The drawstring ends 118 may be tensioned and tied together in, for instance, a knot or bow in order to bias the trim piece assembly 100 radially inward such that the waist of the apparel item 300 is retained against the body surface of a wearer.

Figure 4:
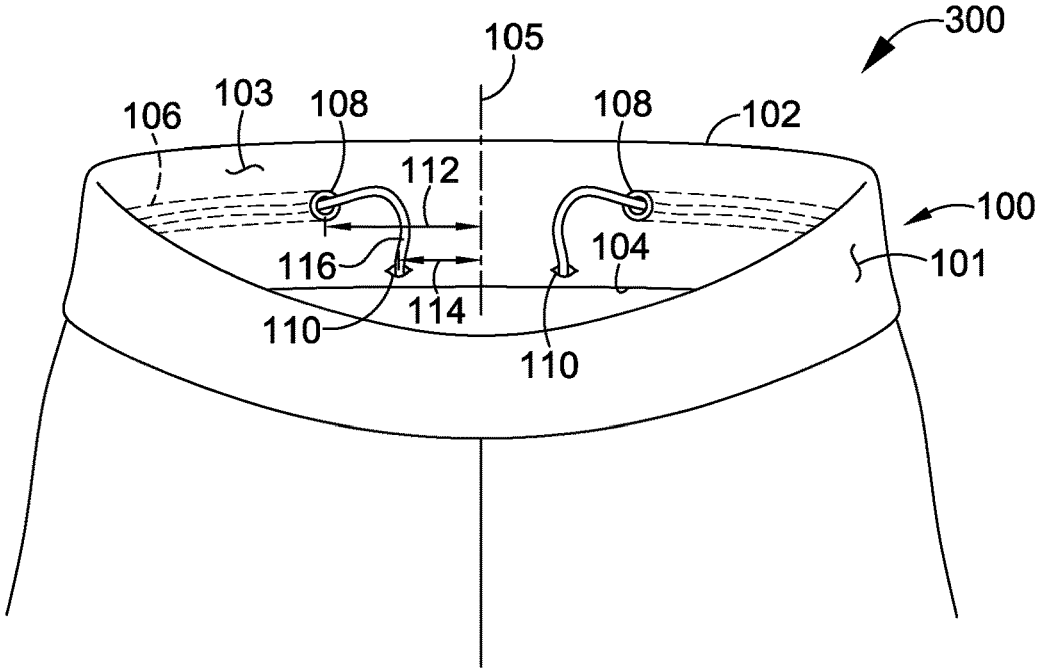
FIG. 4 depicts a back view of the exemplary trim piece assembly incorporated into the article of apparel of FIG. 3, in accordance with aspects herein.

Turning now to FIG. 4, a back view of the article of apparel 300 shown in FIG. 3 is depicted in accordance with aspects herein. As seen in FIG. 4, and as discussed previously, the trim piece assembly 100 generally comprises the first set of apertures 108 providing access to the drawstring channel 106, where each aperture of the first set of apertures 108 is positioned a first distance 112 away from a front centerline 105 of the trim piece assembly 100 on opposing sides of the front centerline 105. The trim piece assembly further comprises the second set of apertures 110 extending from the exterior surface 101 to the interior surface 103 of the trim piece assembly 100, where each apertures of the second set of apertures 110 is positioned a second distance away from the front centerline 105 of the trim piece assembly 100 on opposing sides of the front centerline 105. Also as seen in FIG. 4, the first set of apertures 108 is generally positioned only on the interior surface 103 of the trim piece assembly 100 and not on the exterior surface 101 of the trim piece assembly 100 such that the first set of apertures 108 provides communication between the drawstring channel 106 and the interior surface 103 of the trim piece assembly 100.

Additionally, as seen in FIG. 4, the second set of apertures 110 is depicted as being positioned inferior to the first set of apertures 108 with respect to the upper margin 102 of the trim piece assembly 100. As described herein, the terms "inferior" and "superior" are given their standard anatomical meaning. Therefore, when the second set of apertures 110 is described as being positioned inferior to the first set of apertures 108, it is meant that the second set of apertures 110 is generally positioned closer to lower margin 104 of the trim piece assembly 100, when compared to the first set of apertures 108.

Figure 9:
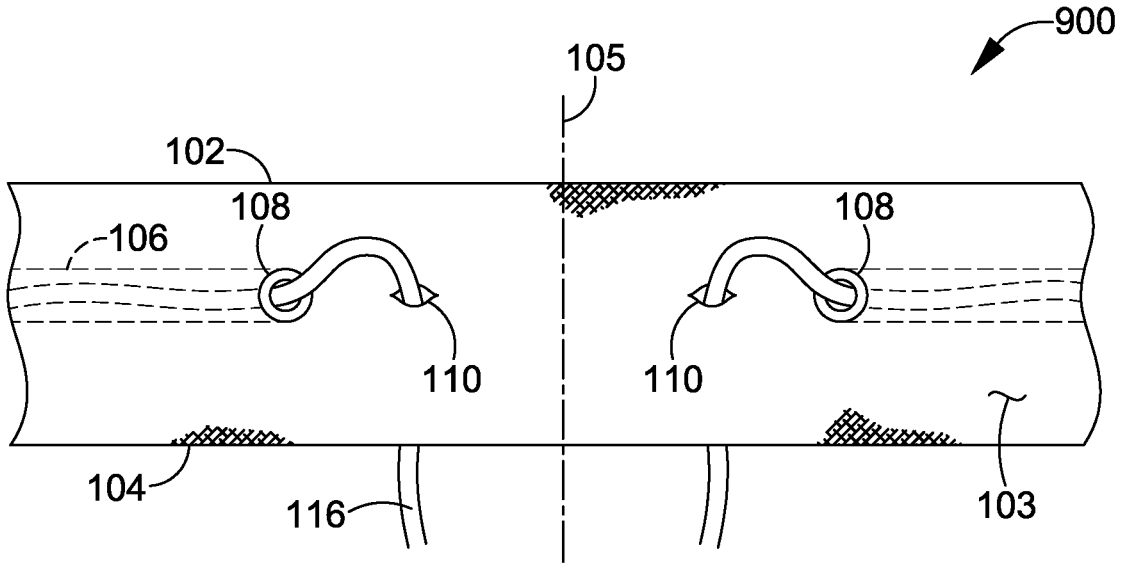
FIG. 9 depicts a back view of an exemplary trim piece assembly having an alternative configuration, in accordance with aspects herein.
Figure 10:
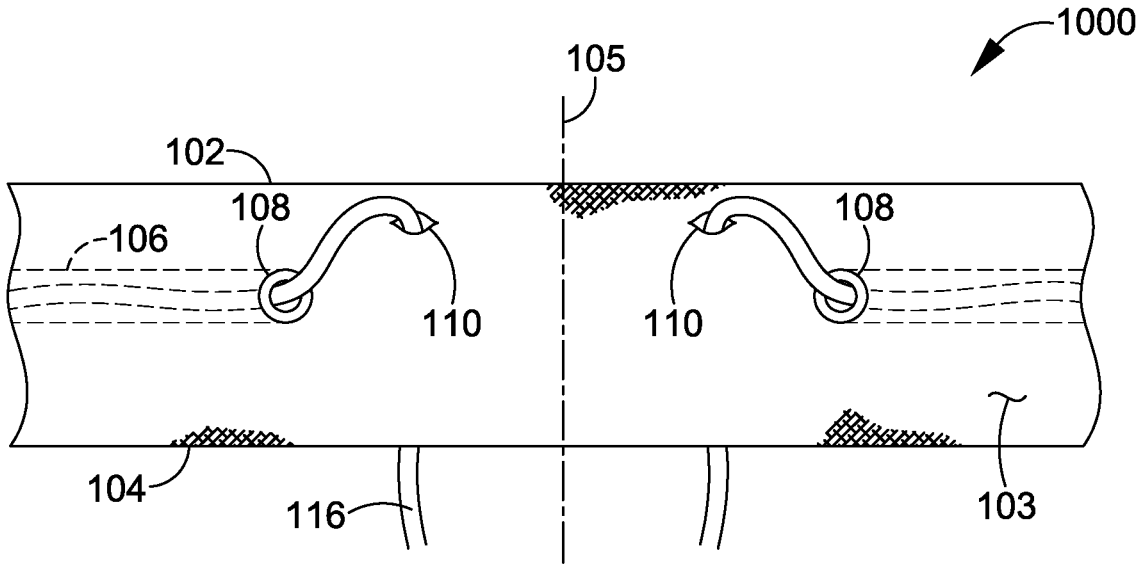
FIG. 10 depicts a back view of an exemplary trim piece assembly having an alternative configuration, in accordance with aspects herein.

Aspects in which the second set of apertures 110 are positioned at different locations with respect to the first set of apertures 108 are considered within the scope of this disclosure. For example, FIG. 9 depicts an exemplary trim piece assembly 900 in which the first set of apertures 108 and the second set of apertures 110 are positioned substantially in-line with each other. In other words, the first set of apertures 108 and the second set of apertures 110 are positioned a same distance away from the upper margin 102 of the trim piece assembly 900. Additionally, FIG. 10 depicts an exemplary trim piece assembly 1000 in which the second set of apertures 110 is positioned superior to the first set of apertures 108 with respect to the upper margin 102 of the trim piece assembly 1000.

Figure 8:
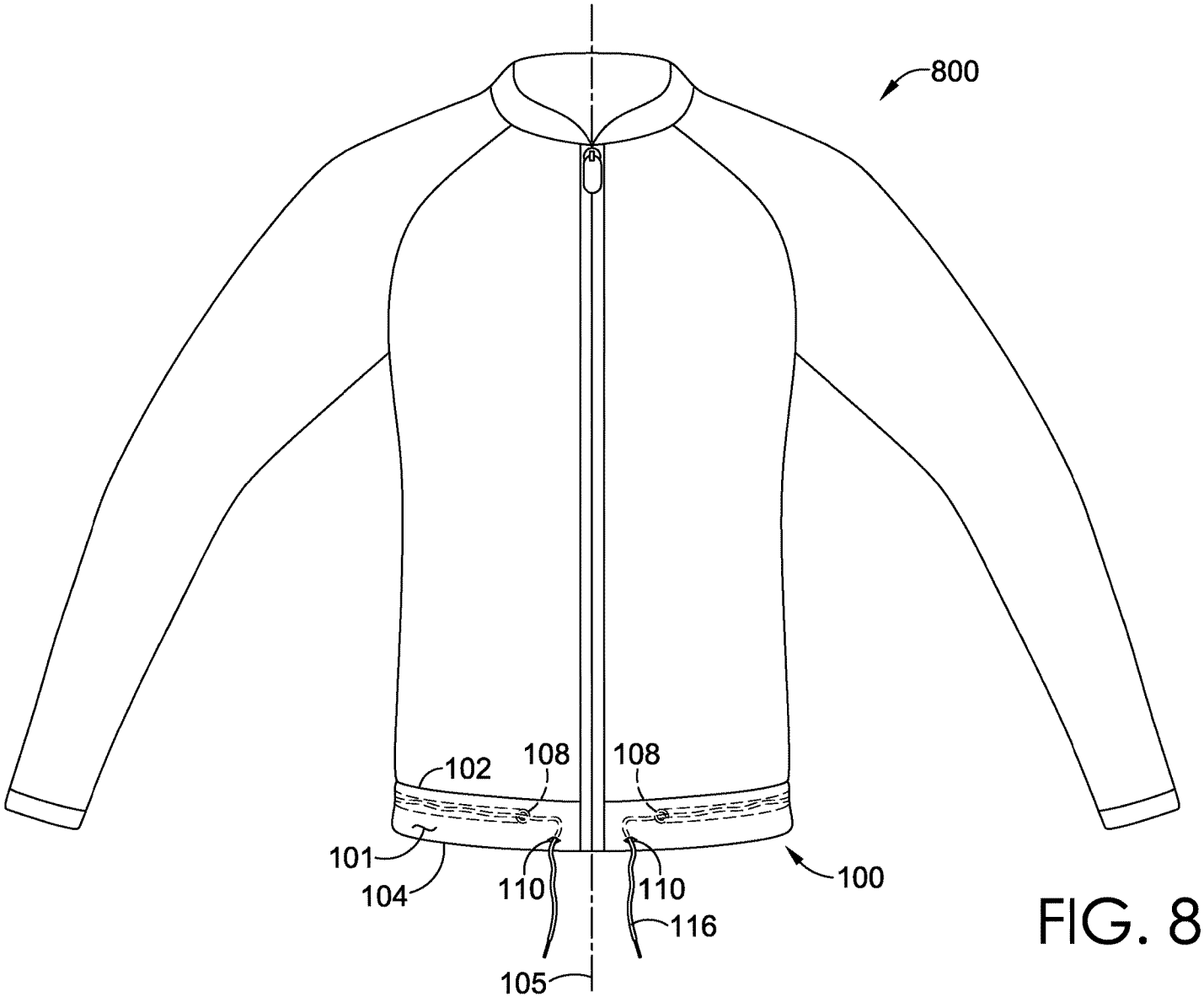
FIG. 8 depicts a front view of an exemplary trim piece assembly incorporated into an upper-body article of apparel, in accordance with aspects herein.

In accordance with aspects herein, the trim piece assembly described herein, such as the trim piece assembly 100, can also be incorporated into an upper body garment, such as a sweatshirt, jacket, bra, or the like. For example, as shown in FIG. 8, the trim piece assembly 100 has been incorporated into an upper body article of apparel 800. Although the article of apparel 800 is shown as a jacket, it is contemplated herein that the article of apparel 800 may be in the form of a shirt, a pullover, a hoodie, a vest, a camisole, a bra or other type of support garment, and the like. In the aspects shown in FIG. 8, the trim piece assembly 100 is generally positioned near a waistline of a wearer, such that the upper body article of apparel 800 can be adjusted to fit snugly around the waist of a wearer. However, one skilled in the art will appreciate that the trim piece assembly 100 may be positioned at any location on either the lower body article of apparel 300, or on the upper body article of apparel 800. For example, the trim piece assembly 100 may be incorporated into a bra as an underband of a bra. Other examples of garments in which the trim piece assembly 100 could be incorporated into includes socks, wrist cuffs, jacket or shirt waistbands, hats, and the like. Any and all aspects, and any variations thereof, are contemplated as being within the scope herein.

Figure 5:
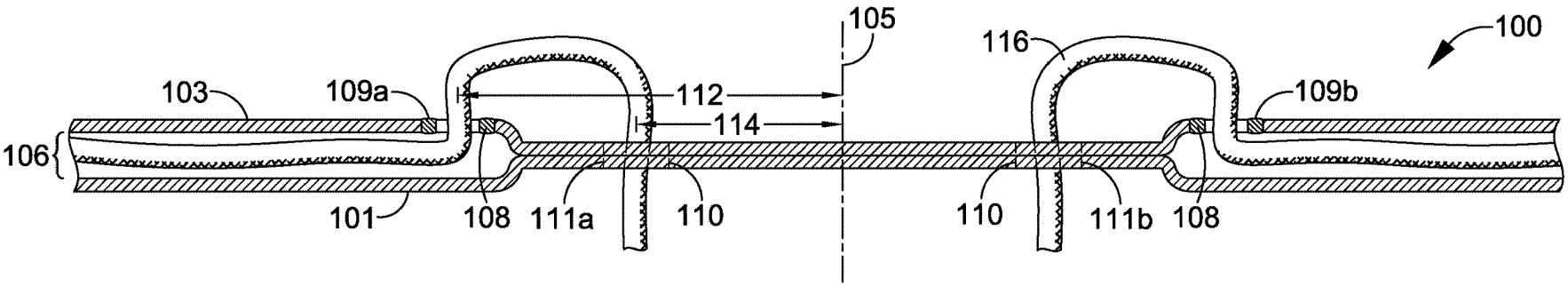
FIG. 5 depicts a top-down cut-away view of the exemplary trim piece assembly of FIG. 1 taken at cut line 5-5, in accordance with aspects herein.

With reference to FIG. 5, a top-down cut-away view of the exemplary trim piece assembly 100 taken at cut line 5-5 of FIG. 1 is depicted in accordance with aspects herein. In FIG. 5, the trim piece assembly 100 is shown as comprising the exterior surface 101 and the interior surface 103, with the drawstring channel 106 positioned between the exterior surface 101 and the interior surface 103. However, as discussed previously, aspects in which the drawstring channel 106 is not positioned between the exterior surface 101 and the interior surface 103 are considered within the scope of this disclosure. As seen in FIG. 5, and as discussed previously, the first set of apertures 108 provide a communication path between the interior surface 103 of the trim piece assembly 100 and the drawstring channel 106. The first set of apertures 108 are positioned a first distance 112 away from a front centerline 105. However, as discussed previously, the first aperture 109*a* and the second aperture 109*b* of the first set of apertures 108 may be positioned different distances away from the front centerline 105, such that the first aperture 109*a* and the second aperture 109*b* are not symmetrical with respect to the front centerline 105. Additionally, as seen in FIG. 5, the first aperture 109*a* is generally positioned on a first side of the front centerline 105, while the second aperture 109*b* is generally positioned on a second opposing side of the front centerline 105.

Still with reference to FIG. 5, the second pair of apertures 110 is depicted as extending from the exterior surface 101 to the interior surface 103 of the trim piece assembly 100. The second pair of apertures 110 may be positioned a second distance 114 away from the front centerline 105, where the second distance 114 is less than the first distance 112. Similar to the first set of apertures 108, the first aperture 111*a* and the second aperture 111*b* of the second set of apertures 110 may be positioned equidistant from the front centerline 105 or different distances away from the front centerline 105 such that the first aperture 111*a* and second aperture 111*b* are not symmetrical with respect to the front centerline 105. As stated, the second distance 114 is generally less than the first distance 112, however aspects in which the second distance 114 is greater than or equal to the first distance 112 are considered within the scope of this disclosure. Also similar to the first set of apertures 108, the first aperture 111*a* is generally positioned on a first side of the front centerline 105, while the second aperture 111*b* is generally positioned on a second opposing side of the front centerline 105. Additionally, in accordance with aspects herein, FIG. 5 depicts that the second set of apertures 110 do not provide access to the drawstring channel 106, but rather are offset from the drawstring channel 106 and extend between the exterior surface 101 and the interior surface 103.

Figure 6:
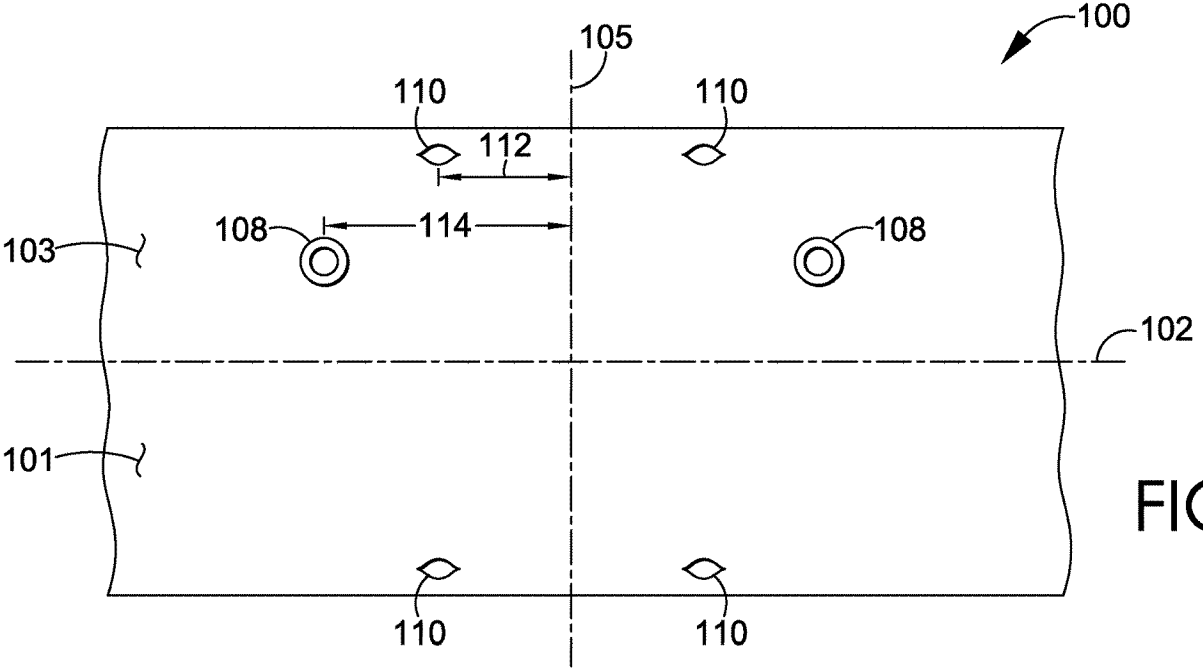
FIG. 6 depicts a deconstructed view of the exemplary trim piece assembly of FIG. 1, in accordance with aspects herein.

Turning now FIG. 6, a deconstructed view of the exemplary trim piece assembly 100 of FIG. 1 is depicted in accordance with aspects herein. In FIG. 6, the trim piece assembly 100 is depicted as being unfolded along the upper margin 102, such that the locations of the first set of apertures 108 and second set of apertures 110 may be explained in greater detail. Because the trim piece assembly 100 has been unfolded, the upper margin 102 is now depicted as a hypothetical longitudinal axis that bisects the trim piece assembly 100 into a superior portion and an inferior portion. The portion of the trim piece assembly 100 located above or superior to the upper margin 102 is the interior surface 103 of the trim piece assembly 100 when the trim piece assembly 100 is assembled. Similarly, in accordance with aspects herein, the portion of the trim piece assembly 100 located below or inferior to the upper margin 102 is the exterior surface 101 of the trim piece assembly 100 when the trim piece assembly 100 is assembled. In exemplary aspects, grommets, such as those shown in FIG. 6 with respect to the first set of apertures 108 may be used to reinforce the apertures 108. Although not shown, grommets may also be used to reinforce the second set of apertures 110. Other reinforcing structures to reinforce the apertures 108 and/or 110 are contemplated herein such as, for example, polyurethane, stitching, thermoplastic polyurethane, fabric, silicone, rubber, plastic, metal and the like. Or, alternatively, neither the first set of apertures 108 nor the second set of apertures 110 may be reinforced.

As shown in FIG. 6, the first set of apertures 108 are positioned only on the interior surface 103 of the trim piece assembly 100 while the second set of apertures 110 are positioned on both the interior surface 103 and the exterior surface 101 of the trim piece assembly 100. To put it another way, when the trim piece assembly 100 is disassembled and laid flat as shown in FIG. 6, the first set of apertures 108 are positioned only on the superior portion of the trim piece assembly 100, while the second set of apertures 110 are positioned on both the superior and inferior portions of the trim piece assembly 100. Thus, when the trim piece 100 is folded along the upper margin 102, the second set of apertures 110 located on the superior portion are aligned with the second set of apertures 110 located on the inferior portion of the trim piece assembly to form a communication path from the interior surface 103 to the exterior surface 101 of the trim piece assembly 100.

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the disclosure and the claims.

The invention claimed is:

1. A trim piece assembly comprising:

a trim piece having an upper margin, a lower margin, an exterior surface, and an interior surface, a first continuous material layer that forms the interior surface of the trim piece, and a second continuous material layer that forms the exterior surface of the trim piece;

a drawstring channel positioned on the trim piece, the drawstring channel formed between the first continuous material layer and the second continuous material layer;

a first set of apertures providing access to the drawstring channel, the first set of apertures positioned a first distance away from a front centerline of the trim piece; and a second set of apertures extending from the exterior surface to the interior surface of the trim piece, the second set of apertures positioned a second distance away from the front centerline of the trim piece, wherein the second set of apertures extend through the first continuous material layer and the second continuous material layer.

2. The trim piece assembly of claim 1, wherein the second distance is less than the first distance.

3. The trim piece assembly of claim 1, wherein the first set of apertures comprises a first pair of apertures, wherein a first aperture of the first pair of apertures is positioned on a first side of the front centerline, and wherein a second aperture of the first pair of apertures is positioned on a second side of the front centerline.

4. The trim piece assembly of claim 1, wherein the second set of apertures comprises a second pair of apertures, wherein a first aperture of the second pair of apertures is positioned on a first side of the front centerline, and wherein a second aperture of the second pair of apertures is positioned on a second side of the front centerline.

5. The trim piece assembly of claim 1, wherein the first set of apertures extend only through the first continuous material layer of the trim piece.

6. A waistband assembly comprising:

a first continuous material layer that forms an interior surface of the waistband assembly;

a second continuous material layer that forms an exterior surface of the waistband assembly;

a drawstring channel that extends circumferentially around the waistband assembly terminating at a front portion thereof, the drawstring channel formed between the first continuous material layer and the second continuous material layer;

a first pair of apertures at the front portion of the waistband assembly, the first pair of apertures positioned a first distance from a front centerline of the waistband assembly on opposing sides of the front centerline, the first pair of apertures providing access to the drawstring channel; and a second pair of apertures at the front portion of the waistband assembly, the second pair of apertures positioned a second distance from the front centerline of the waistband assembly on opposing sides of the front centerline, the second pair of apertures extending from the exterior surface to the interior surface of the waistband assembly, wherein the second pair of apertures extend through the first continuous material layer and the second continuous material layer.

7. The waistband assembly of claim 6, wherein the second pair of apertures is positioned inferior to the first pair of apertures with respect to an upper margin of the waistband assembly.

8. The waistband assembly of claim 6, wherein the second pair of apertures is positioned superior to the first pair of apertures with respect to an upper margin of the waistband assembly.

9. The waistband assembly of claim 6, wherein the second pair of apertures is positioned equidistant with the first pair of apertures with respect to an upper margin of the waistband assembly.

10. A trim piece incorporated into a garment, the trim piece comprising:

an interior surface, an exterior surface, an upper margin, a lower margin, a first continuous material layer, and a second continuous material layer;

a drawstring channel formed between the first continuous material layer and the second continuous material layer, wherein the drawstring channel extends circumferentially around the trim piece and terminates adjacent a front centerline thereof;

a first pair of apertures positioned a first distance away from the front centerline, the first pair of apertures extending only through the first continuous material layer and providing access to the drawstring channel; and a second pair of apertures positioned a second distance away from the front centerline, the second pair of apertures extending through the first continuous material layer and the second continuous material layer.

11. The trim piece of claim 10, wherein the first pair of apertures comprises a first aperture positioned on a first side of the front centerline and a second aperture positioned on a second side of the front centerline; and wherein the second pair of apertures comprises a first aperture positioned on the first side of the front centerline and a second aperture positioned on the second side of the front centerline.

12. The trim piece of claim 11 further comprising a drawstring disposed in the drawstring channel, the drawstring having drawstring ends and a drawstring intervening portion.

13. The trim piece of claim 12, wherein each of the drawstring ends is adapted to exit the drawstring channel and pass through a respective aperture of the first pair of apertures such that the drawstring ends are positioned on the interior surface of the trim piece.

14. The trim piece of claim 13, wherein the each of the drawstring ends is further adapted to pass through a respective aperture of the second pair of apertures, such that the drawstring ends are positioned on the exterior surface of the trim piece.

15. The trim piece of claim 10, wherein the first distance away from the front centerline is greater than the second distance away from the front centerline.

16. The trim piece of claim 10, wherein the garment comprises a sweatshirt or jacket.

17. The trim piece of claim 16, wherein the trim piece is incorporated into the sweatshirt or jacket as a waistband.

18. The trim piece of claim 10, wherein the garment comprises pants or shorts.

19. The trim piece of claim 18, wherein the trim piece is incorporated into the pants or shorts as a waistband.

* * * * *